US007187886B2

(12) United States Patent
Kawasumi

(10) Patent No.: US 7,187,886 B2
(45) Date of Patent: Mar. 6, 2007

(54) IMAGE FORMING APPARATUS HAVING A SECURING MEMBER TO SECURE AN IMAGE FORMING UNIT TO A HOUSING BODY

(75) Inventor: Ryoichi Kawasumi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/220,648

(22) Filed: Sep. 8, 2005

(65) Prior Publication Data

US 2006/0067733 A1 Mar. 30, 2006

(30) Foreign Application Priority Data

Sep. 28, 2004 (JP) ..... 2004-281645

(51) Int. Cl.
*G03G 21/16* (2006.01)

(52) U.S. Cl. ..... 399/111; 399/112

(58) Field of Classification Search ..... 399/111, 399/112, 113, 114

See application file for complete search history.

(56) References Cited

U.S. PATENT DOCUMENTS 6,453,135 B1 * 9/2002 Sameshima et al. ..... 399/110

FOREIGN PATENT DOCUMENTS

JP 11-174940 A 7/1999
JP 2000-181329 A 6/2000

* cited by examiner

*Primary Examiner*—David M. Gray
*Assistant Examiner*—Bryan Ready
(74) *Attorney, Agent, or Firm*—Fitzpatrick, Cella, Harper & Scinto

(57) ABSTRACT

The present invention relates to an image forming apparatus to which a process cartridge can be detachably attached, comprising: a housing body to which the process cartridge is attached; an opening and closing portion for detachably attaching the process cartridge; and securing means for securing the process cartridge to a position where an image can be formed. The securing means is turned when the process cartridge is detached and attached, the image forming apparatus further comprises force-applying means which applies a force to the process cartridge to a position where the process cartridge is secured or a position where the process cartridge is opened, and an image is not formed when the securing means is in a phase other than a process cartridge securing phase.

9 Claims, 7 Drawing Sheets

(a)

(b)

IMAGE FORMING APPARATUS HAVING A SECURING MEMBER TO SECURE AN IMAGE FORMING UNIT TO A HOUSING BODY

BACKGROUND OF THE INVENTION (1) Field of the Invention

The present invention relates to a process cartridge and an electrophotographic image forming apparatus for forming an image using the process cartridge.

The process cartridge is a cartridge into which charging means and development means, or cleaning means and an electrophotographic photosensitive member are integrally accommodated, and this cartridge can be detachably attached to an image forming apparatus body.

Another example of the process cartridge is a cartridge into which an electrophotographic photosensitive member and at least one of the charging means, the development means and the cleaning means are integrally accommodated, and the cartridge can be detachably attached to the image forming apparatus body.

Another example of the process cartridge is a cartridge into which at least the development means and the electrophotographic photosensitive member are integrally accommodated, and the cartridge can be detachably attached to the image forming apparatus body.

The electrophotographic image forming apparatus (image forming apparatus, hereinafter) includes an electrophotographic copying machine, an electrophotographic printer (e.g., LED printer, laser beam printer and the like), an electrophotographic facsimile machine, and an electrophotographic word processor.

(2) Description of the Related Art

Conventionally, an image forming apparatus using electrophotographic image forming process employs such a process cartridge method that a photosensitive member and process means acting on the photosensitive member are integrally accommodated in a cartridge, and the cartridge is detachably attached to an image forming apparatus body. According to the process cartridge method, since an operator (user) can perform maintenance of the apparatus himself or herself without asking a service man, the operability can remarkably be enhanced. Therefore, the process cartridge method is widely used in image forming apparatuses. When the process cartridge is attached to the image forming apparatus body, it is necessary to precisely maintain the positional relation between the process cartridge and the image forming apparatus body when the attaching operation of the process cartridge is completed while maintaining an appropriate operating feeling.

As a method which is widely used for positioning the process cartridge with respect to the image forming apparatus and for maintaining the position, there is a method in which the process cartridge is provided with a projection, the apparatus body is provided with a positioning portion with which the projection is engaged, and when the projection is engaged with the positioning portion, a spring applies a force to the process cartridge to latch the process cartridge (see patent document 1, FIG. 6 for example).

A conventional positioning and holding structure of a process cartridge (cartridge 110, hereinafter) with respect to the apparatus body will be explained using FIG. 6.

The cartridge 110 is provided with circular projections 150 as positioning means. The projections 150 are disposed on side surfaces of opposite ends of the cartridge frame in the longitudinal direction. The projection 150 projects outward of the cartridge frame in parallel to an axis of the photosensitive member drum incorporated in the cartridge 110.

The cartridge holding position of the side plate 160 of the image forming apparatus is formed with U-shaped grooves 170 (170Y, 170M, 170C, 170K) as positioning portions. The U-shaped grooves are disposed such that the circular projections 150 are precisely received at predetermined positions. A cartridge attaching space sandwiched by the pair of left and right side plates 160 is provided in the apparatus body. Guide members 161 (161Y, 161M, 161C, 161K) as cartridge attaching auxiliary means as shown in FIG. 6 are mounted on left and right side surfaces of the space. Each of the guide members 161 is provided with an inclined surface 161*a* for guiding the process cartridge 110 of the guide member 161. The inclined surface 161*a* is inclined diagonally downward.

Linear springs 162 (162Y, 162M, 162C, 162K) as latches for holding the cartridge 110 are mounted on the apparatus body. A tip end of the linear spring 162 is formed with a sandwiching portion for sandwiching a bottom of the U-shaped grooves 170 from left and right sides. A distance between the narrowest portions of the sandwiching portion is smaller than a diameter of the circular projection 150 of the cartridge.

A procedure for attaching the cartridge 110 to the apparatus body will be explained. First, the opening and closing portion of an exterior (not shown) of the apparatus and the transfer belt unit are opened, and as shown in the cartridge 110K in FIG. 6, a bottom surface 110*a* of the cartridge 110 is inserted into the apparatus such that the bottom surface 110*a* is dropped thereinto along the inclined surface 161*a* of the guide member 161. Next, as shown in the cartridge 110M in FIG. 6, the projection 150 is dropped into the U-shaped grooves 170, the projection 150 rides over the tip end sandwiching portion of the linear spring 162 and is abutted against the bottom of the U-shaped grooves 170. At that time, the projection 150 is sandwiched by the sandwiching portion of the linear spring 162, and the cartridge 110 is secured to the side plate 160 of the apparatus body by the sandwiching force.

According to the image forming apparatus of the patent document 1, however, the sandwiching force of the linear spring 162 against the projection 150 of the cartridge 110 acts as a resistance when the cartridge is dropped. Since the projection 150 and the linear spring 162 always in contact until the projection 150 abuts against the bottom of the U-shaped grooves 170, this resistance acts until last when the cartridge 110 is positioned to the normal position. As a result, the insertion becomes insufficient, the cartridge floats or rides over, and the cartridge is not positioned to the normal position. With this behavior of the photosensitive member drum incorporated in the cartridge is also varied, and this affects an image formed by the photosensitive member drum in some cases. Further, excessive load is applied also to the transfer belt unit which is opposed to and abuts against the photosensitive member drum, the image forming region of the belt is damaged, this affects the image formation, the image quality is deteriorated, and the parts are damaged in some cases.

If the cartridge 110 is repeatedly detached and attached, the sandwiching portion of the linear spring 162 shaves the projection 150 of the cartridge and with this, the operating feeling when the cartridge is inserted becomes improper. The sandwiching force at the time of latch is reduced, reliable positioning and securing operation can not be carried out, and this affects the image formation in some cases.

As described in patent document 2 (Japanese Patent Application Laid-open No. 2000-181329), to enhance the attaching and detaching operation of the process cartridge, there is a conventionally proposed structure using a toggle latch. FIG. 7 is a diagram used for explaining an attaching and detaching structure of another conventional process cartridge.

In FIG. 7, a process cartridge 202 includes a projecting to-be-held portion 202*a*. An image forming apparatus body 214 includes a reference surface 291 for positioning the process cartridge 202 which is attached, a holding member 270 which is rotatably supported by the image forming apparatus body 214 and which has a first surface 271 and a second surface 272, and a force-applying member 280 for applying a force to the holding member 270. The holding member 270 can assume a first attitude in which the holding member 270 receives rotation moment from the force-applying member 280 and pushes and holds the to-be-held portion 202*a* of the process cartridge 202 in an attaching direction of the process cartridge 202 in the first surface 271, and a second attitude in which the holding member 270 receives rotation moment in a direction opposite from the first attitude of the holding member 270 from the force-applying member 280 and pushes the to-be-held portion 202*a* of the process cartridge 202 in the attaching and detaching direction of the process cartridge in the second surface 272.

With the above structure, when the process cartridge is attached to the image forming apparatus body, the process cartridge is pulled in, and when the process cartridge is attached to and detached from the image forming apparatus body, the process cartridge can be pushed out. Therefore, the attaching and detaching operability of the process cartridge is remarkably enhanced.

[Patent Document 1] Japanese Patent Application Laid-open No. H11-174940

[Patent Document 2] Japanese Patent Application Laid-open No. 2000-181329

According to the image forming apparatus of the patent document 2, however, although it is possible to prevent the operability from being deteriorated, since the insertion of the cartridge is insufficient, the cartridge is not positioned to the normal position in some cases. This affects an image to be formed, and the transfer belt is damaged in some cases.

SUMMARY OF THE INVENTION

It is an object of the present invention to provide an image forming apparatus in which a process cartridge can easily be attached to an apparatus body, appropriate operating feeling is secured, the positional precision between the process cartridge and the apparatus body is excellent, and the image forming region of the transfer belt unit is not damaged.

To solve the above problem, the present invention provides an image forming apparatus to which a process cartridge can be detachably attached, comprising a housing body to which the process cartridge is attached, an opening and closing portion for detachably attaching the process cartridge, and securing means for securing the process cartridge to a position where an image can be formed, wherein the securing means is turned when the process cartridge is detached and attached, the image forming apparatus further comprises force-applying means which applies a force to the process cartridge to a position where the process cartridge is secured or a position where the process cartridge is opened, and an image is not formed when the securing means is in a phase other than a process cartridge securing phase.

According to the present invention, the toggle latch is used as the securing means which positions and holds the process cartridge to the body. The toggle latch and the transfer belt unit or a cartridge-taking out opening and closing portion are interfered with each other in a state in which the cartridge is not in the normal position. With this, the apparatus body is not driven in the state in which the cartridge is not in the normal position and thus, the image forming region of the transfer belt unit is not damaged, and the transfer belt can be protected.

The toggle latch also functions as the guide means for the process cartridge. With this, it is easy to attach the process cartridge to the apparatus body, an appropriate operating feeling can be secured, and the cartridge can be positioned and held reliably when the attaching operation is completed.

DESCRIPTION OF THE PREFERRED EMBODIMENT

Figure 1:
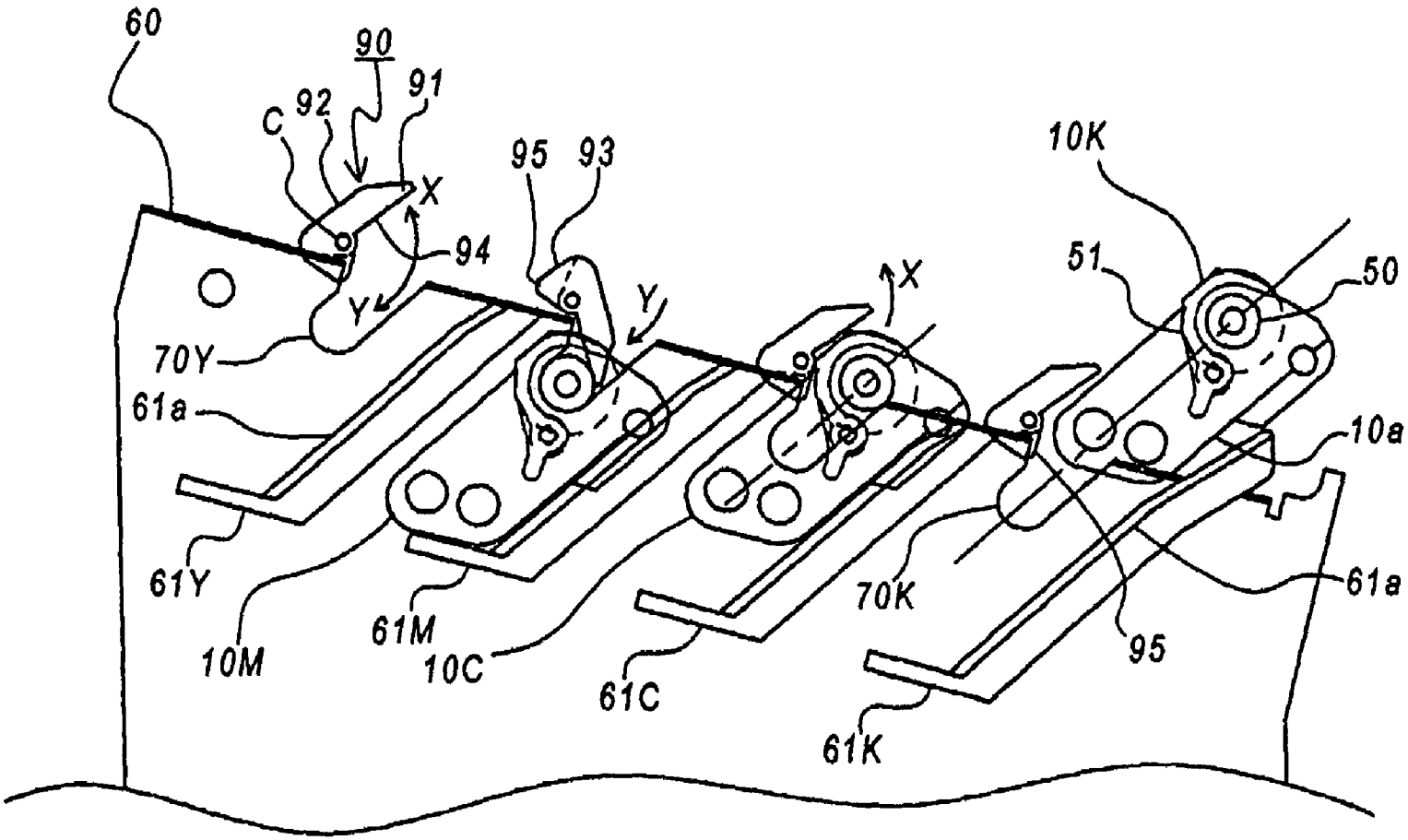
FIG. 1 is a side sectional view of an essential portion of an image forming apparatus.

An embodiment of an image forming apparatus according to the present invention will be explained using the drawings.

(Entire Structure)

The entire structure of the image forming apparatus will be explained using FIGS. 5(*a*) and 5(*b*). The image forming apparatus shown in FIGS. 5(*a*) and 5(*b*) is one example of a full-color image forming apparatus (full-color printer) having an in-line type intermediate transfer belt (intermediate transfer means) employing the electrophotographic type.

The image forming apparatus 2 has four process cartridges (cartridges 10 (10Y, 10M, 10C, 10K), hereinafter) disposed on a substantially horizontal straight line at equal distances from one another. These process cartridges form yellow, magenta, cyan, and black images, respectively. A drum type electrophotographic photosensitive member (photosensitive member drum 18, hereinafter) as a image bearing member is disposed substantially at central portion of each of the cartridges 10, a primary charger 19 as charging means, a development unit 30 as development means and a drum cleaner 31 as cleaning means are disposed around the photosensitive member drum 18, and these members constitute one cartridge.

A primary charger 19 uniformly charges a surface of the photosensitive member drum 18 with predetermined negative potential by charging bias applied from a charging bias power source (not shown). The development unit 30 includes toner therein, and attaches toner of various colors to each electrostatic latent image formed on the photosensitive member drum 18 and develops the same as a toner image (visualizes). The drum cleaner 31 includes a cleaning blade for removing, from the photosensitive member drum 18, residual toner which remained on the photosensitive member drum 18 at the time of the primary transfer.

A transfer roller 20 as primary transfer means is disposed at a location opposed to the photosensitive member drum 18. A light-exposure apparatus 11 is disposed below a location between the primary charger 19 and the development unit 30. The transfer roller 20 is disposed in a transfer belt unit 12, and is disposed such that the transfer roller 20 is opposed to the photosensitive member drum 18 and a force is applied to the transfer roller 20. The light-exposure apparatus 11 comprises laser emitting means, a polygon lens, and a reflection mirror. The laser emitting means emits light in correspondence with time series electric digital picture element signal of given image information. Each photosensitive member drum 18 is exposed to light, thereby forming electrostatic latent images of various colors on the surface of each photosensitive member drum 18 charged by the primary charger 19 in accordance with the image information.

The transfer belt unit 12 includes a driving roller 71 which also functions as a secondary transfer opposed roller. The driving roller 71 is opposed to a secondary transfer roller 32. A fixing apparatus having a fixing roller 41 and a pressure roller 40 is disposed downstream from the secondary transfer roller 32 in the transfer direction of a transfer material P. The fixing apparatus is of vertical path structure.

The transfer materials P set in a supply cassette 3 are separated from each other one by one and supplied by a supply roller 4, the transfer materials P are conveyed to nips of the secondary transfer roller 32 and the driving roller 71 by a registration roller pair 5, toner image is transferred onto the transfer material P, the image is fixed thereon by the fixing apparatus comprising the pressure roller 40 and the fixing roller 41, and the transfer material P is discharged into a discharge tray 44 by the discharge roller 43.

The cartridge 10 and the transfer belt unit 12 have lifetime shorter than that of the image forming apparatus 2 due to their properties, and to complete the lifetime of the body, the cartridge 10 and the transfer belt unit 12 must be exchanged. Thereupon, as shown in FIG. 5B, to facilitate the exchanging operation of the cartridge 10 and the transfer belt unit 12, a unit having the discharge tray 44 and the transfer belt unit 12 is formed as an upper door unit 101 such that the upper door unit 101 can opened and closed with respect to the image forming apparatus body. With this structure, both the cartridge 10 and the transfer belt unit 12 are formed such that they can detachably attached by opening the upper door unit 101 upwardly of the body (direction of the arrow A in FIG. 5B), thereby enhancing the maintenance performance (i.e., the cartridge is detached from and attached to the apparatus body in a direction perpendicular to an axis of the photosensitive member drum 18).

(Detachably Attaching Structure of Process Cartridge)

Figure 2:
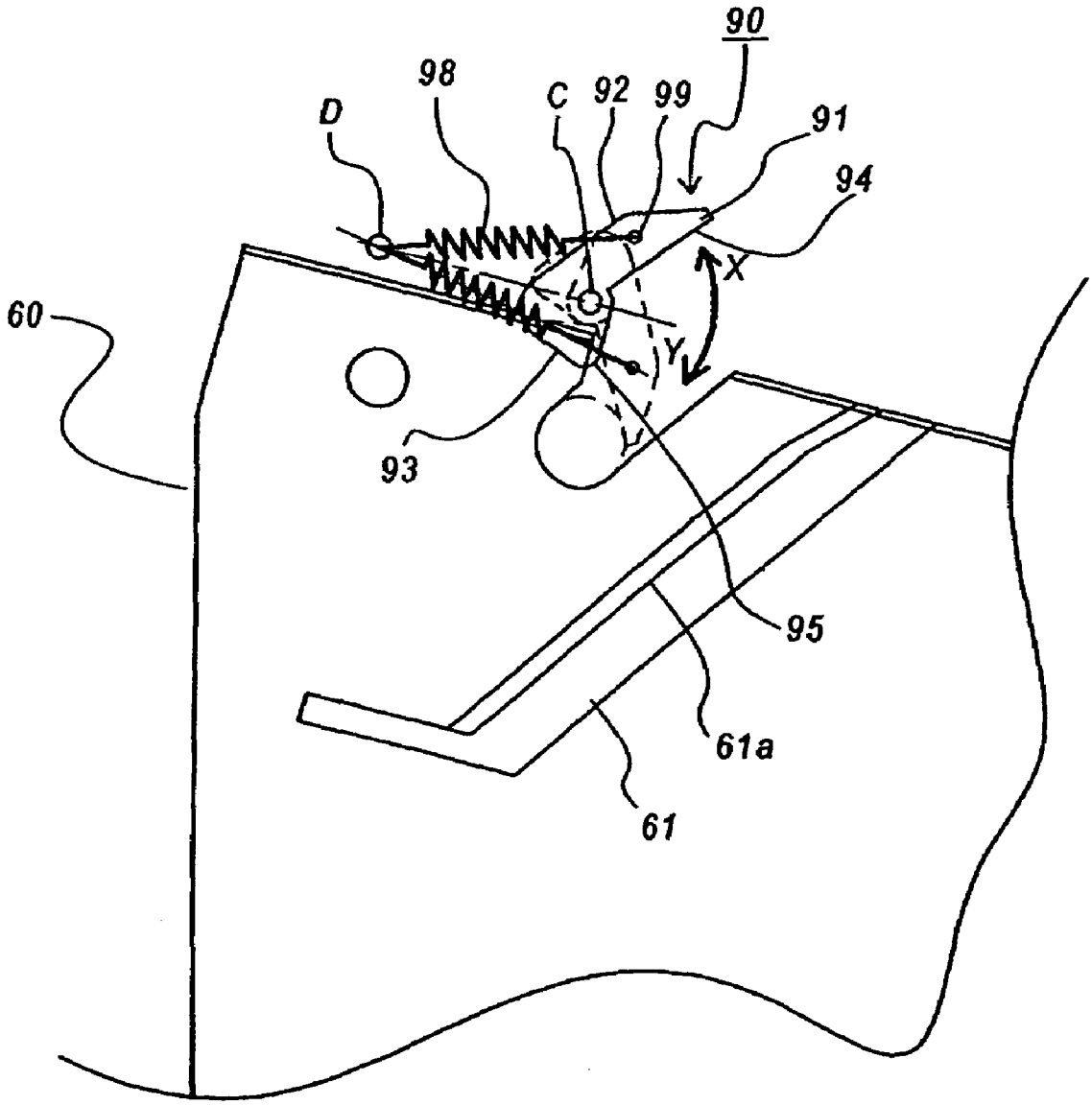
FIG. 2 is a diagram used for explaining securing means.
Figure 3:
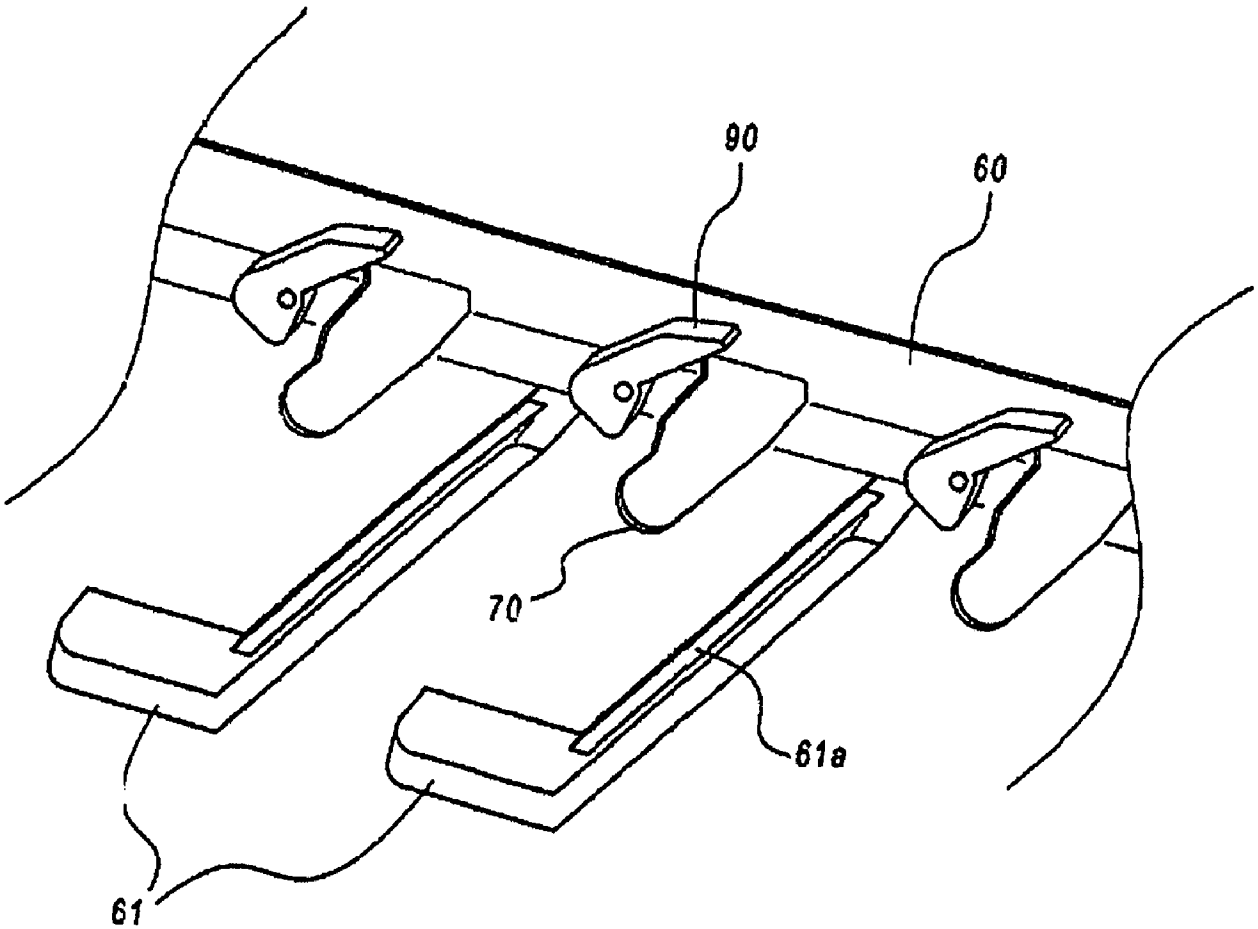
FIG. 3 is a diagram used for explaining an attaching portion of a process cartridge.
Figure 4:
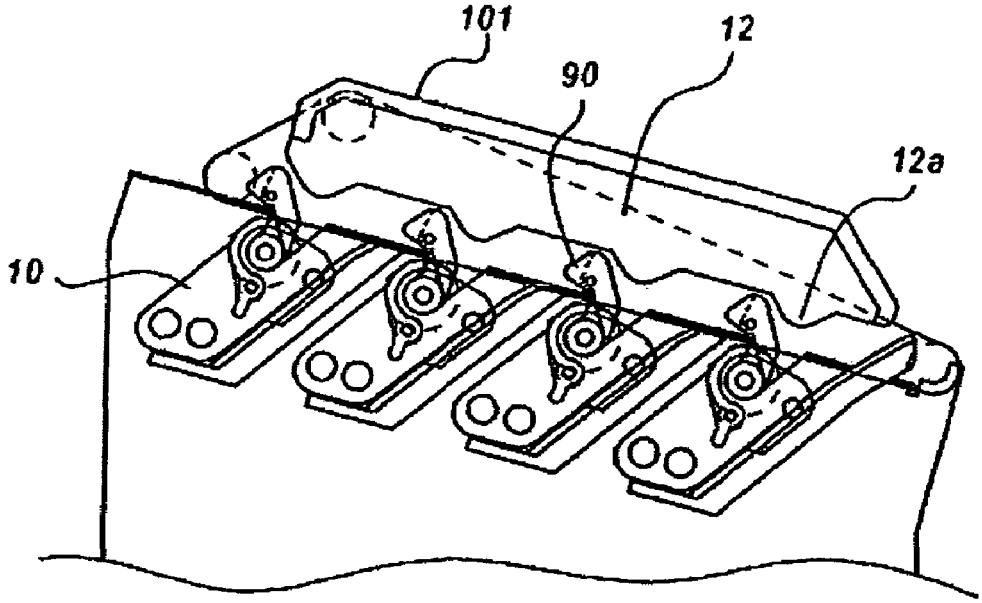
FIGS. 4(*a*) and 4(*b*) are diagrams used for explaining an attached state of the process cartridge.
Figure 4:
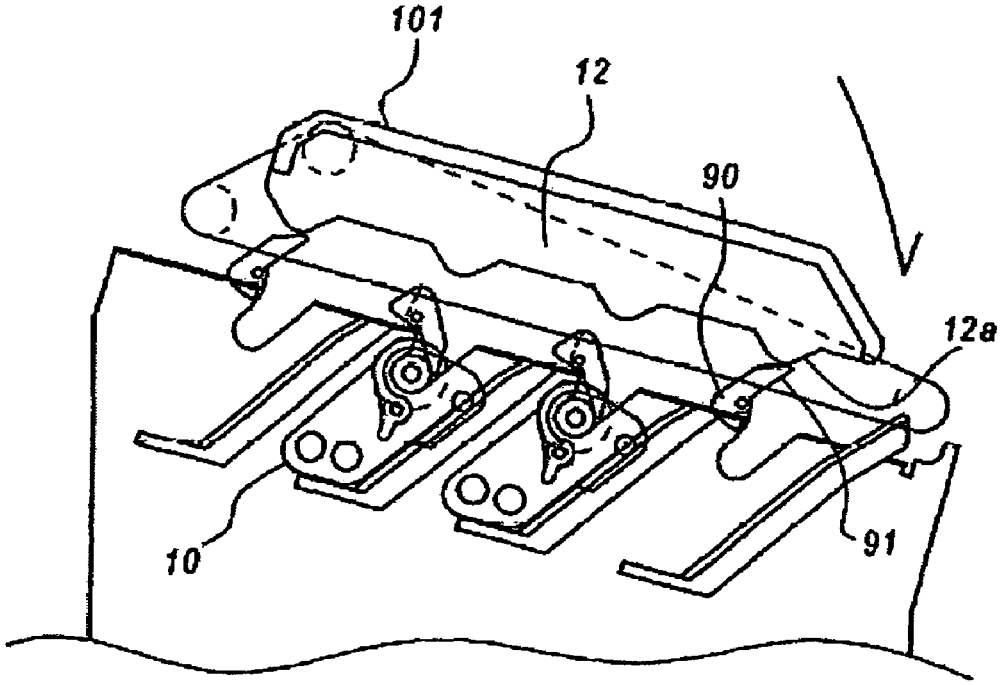

Next, a structure for detachably attaching the process cartridge to the image forming apparatus body will be explained. FIG. 1 is a side sectional view of an essential portion of the image forming apparatus, FIG. 2 is a diagram used for explaining securing means, FIG. 3 is a diagram used for explaining an attaching portion of a process cartridge, and FIG. 4 are diagrams used for explaining an attached state of the process cartridge.

As shown in FIG. 1, the cartridge 10 is provided with a circular projection 50 functioning as positioning means. A side plate 60 is a portion of a housing body of the image forming apparatus 2. The side plate 60 is formed at its cartridge holding position with U-shaped grooves 70 (70Y, 70M, 70C, 70K) as the positioning portions. The U-shaped grooves 70 are disposed such that they receive the projections 50 at predetermined positions precisely. Guide members 61 (61Y, 61M, 61C, 61K) as cartridge attaching auxiliary means are mounted in the apparatus body. The above-described structure is the same as that explained in the background technique.

The embodiment is characterized in that a toggle latch is used as the securing means for positioning the cartridge 10 with respect to the image forming apparatus body and maintaining the position.

A plurality (four) of toggle arms 90 which are bodies of the toggle latches are provided in correspondence with cartridge insertion ports, and the toggle arm 90 is provided on the side plate 60. The toggle arm 90 includes a rotation shaft C which turnably supports the side plate 60, a latch portion 91 which can push the projection 50 of the cartridge 10 against a U-shaped groove 70, and an engaging portion 95 which engages with the cartridge 10. The toggle arm 90 projects from the side plate 60. The toggle arm 90 includes a first inclined surface 92, a second inclined surface 93 and a third inclined surface 94 which also function as guide surfaces when the cartridge is inserted. The inclined surfaces 92, 93 and 94 are formed such as to extend the guide members 61 at later-described several phases. The engaging portion 95 is arranged such that it engages with the projection surface 51 on the side of the cartridge only in the vicinity of a halfway position in the attaching operation of the cartridge (position of the cartridge 10C in FIG. 1). Like the projection 50, the projection surface 51 projects outward of the cartridge frame such that the projecting height of the projection surface 51 is lower than that of the projection 50. As shown in the perspective view of FIG. 3, the projection 50 and the projection surface 51 are mounted in the attaching space of the cartridge 10 formed by the pair of left and right side plates 60 such that the projection 50 and the projection surface 51 are mounted from inside to outside of the side plate 60.

Next, structure of the toggle arm 90 will be explained with reference to FIG. 2.

In FIG. 2, the toggle arm 90 is shown with two positions, i.e., a first position (position where the cartridge is opened) shown with a solid line and a second position (position where the cartridge is secured) which is rotated from the first position in the direction of the arrow Y and shown with a broken line. The toggle arm 90 can turn between the first position and the second position around the rotation shaft C.

As shown in FIG. 2, the toggle arm 90 includes an extension spring 98 which is not shown in FIG. 1. The extension spring 98 is engaged with a spring fulcrum D provided on the side plate 60 and with a spring hook 99 provided on the toggle arm 90. The spring hook 99 is located on one side (upper side in the drawing) of a line segment C-D connecting the spring fulcrum D and the rotation shaft C on the side plate when the toggle arm 90 is located in the first position shown with the solid line in FIG. 2, and the spring hook 99 is located on the other side (lower side in the drawing) of the line segment C-D when the toggle arm 90 is located in the second position shown with the broken line.

With the above structure, when the toggle arm 90 is in the first position shown with the solid line, since moment is acting in the X direction by the extension spring 98, the toggle arm 90 is held at the first position when other external force is not acting. If moment in the direction of the arrow Y in FIG. 2 is applied to the toggle arm 90 in this state, the toggle arm 90 turns in the direction of the arrow Y by the extension spring 98, and when the spring hook 99 moves downward from the extension line of the line segment C-D, the moment generated by the extension spring 98 is changed from the direction of the arrow Y into the direction of the arrow Y, and when other external force is not acting, the toggle arm 90 is held at the second position.

Based on the above-described structure of the toggle arm 90, procedure of an operator to attach the cartridge to the apparatus body will be explained with reference to FIG. 1 again.

Figure 5:
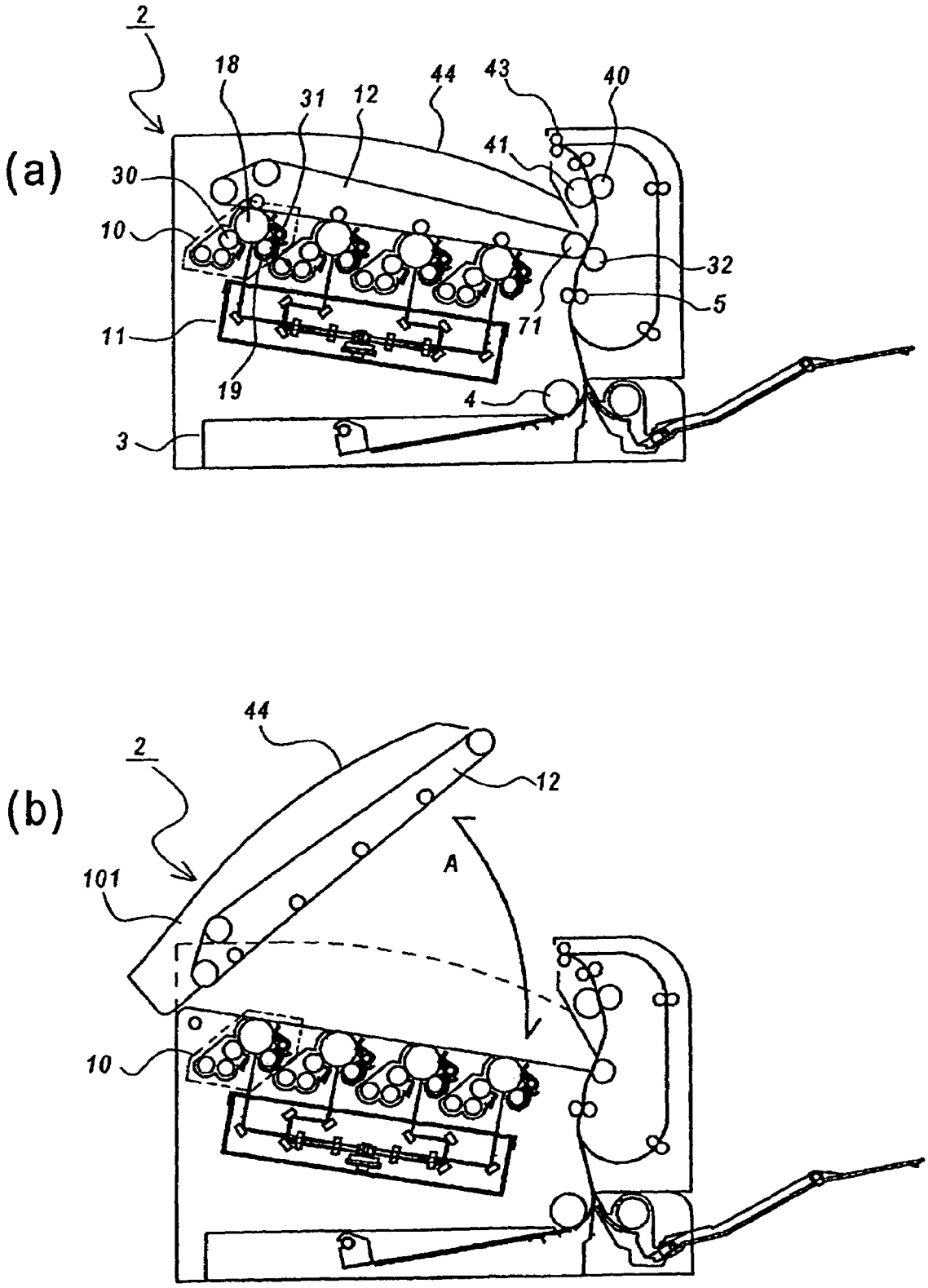
FIGS. 5(*a*) and 5(*b*) are diagrams used for explaining a structure of the image forming apparatus of an embodiment.
Figure 6:
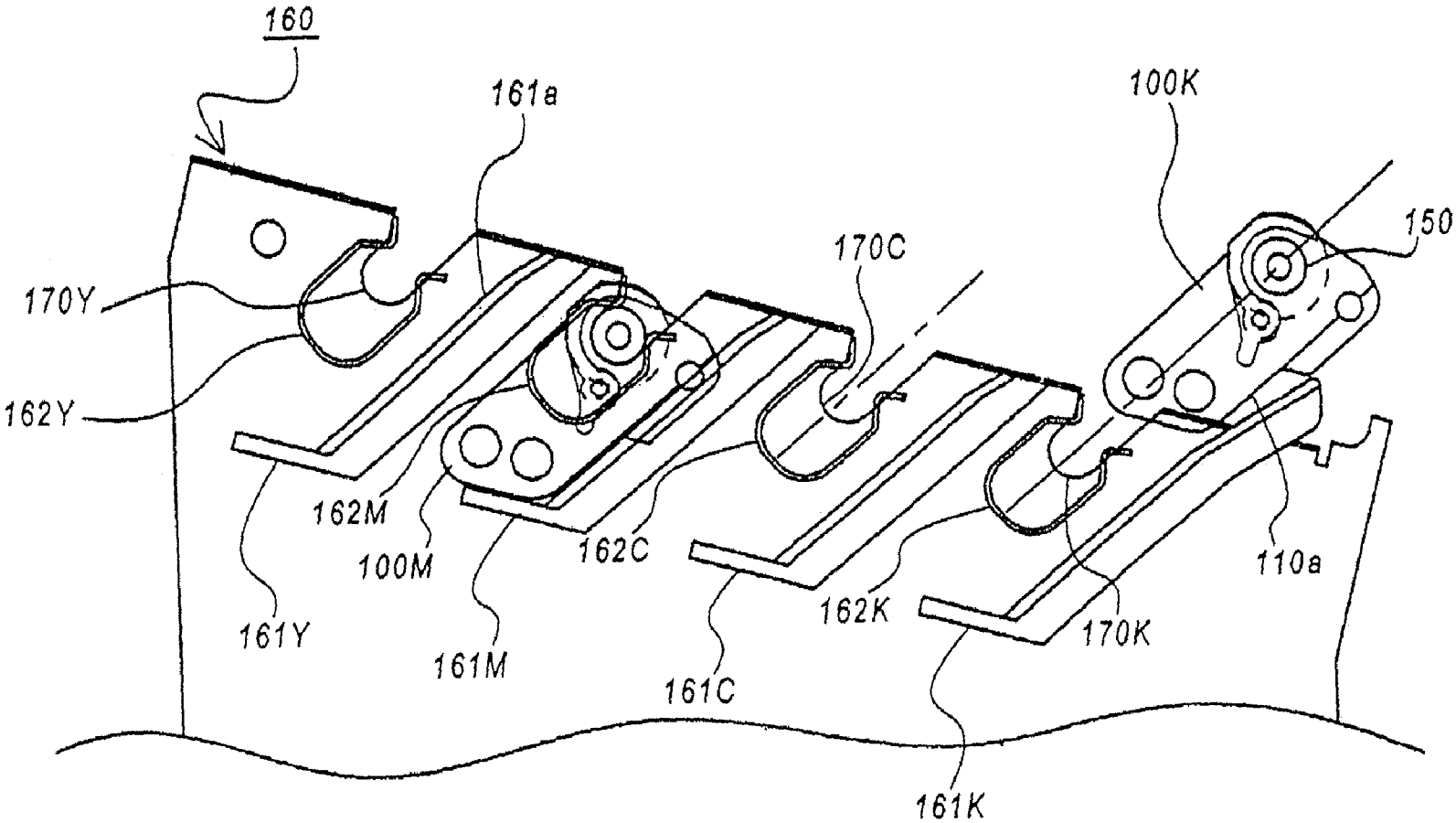
FIG.6 PRIOR ART
FIG. 6 is a diagram used for explaining a positioning and holding structure of a conventional process cartridge.
Figure 7:
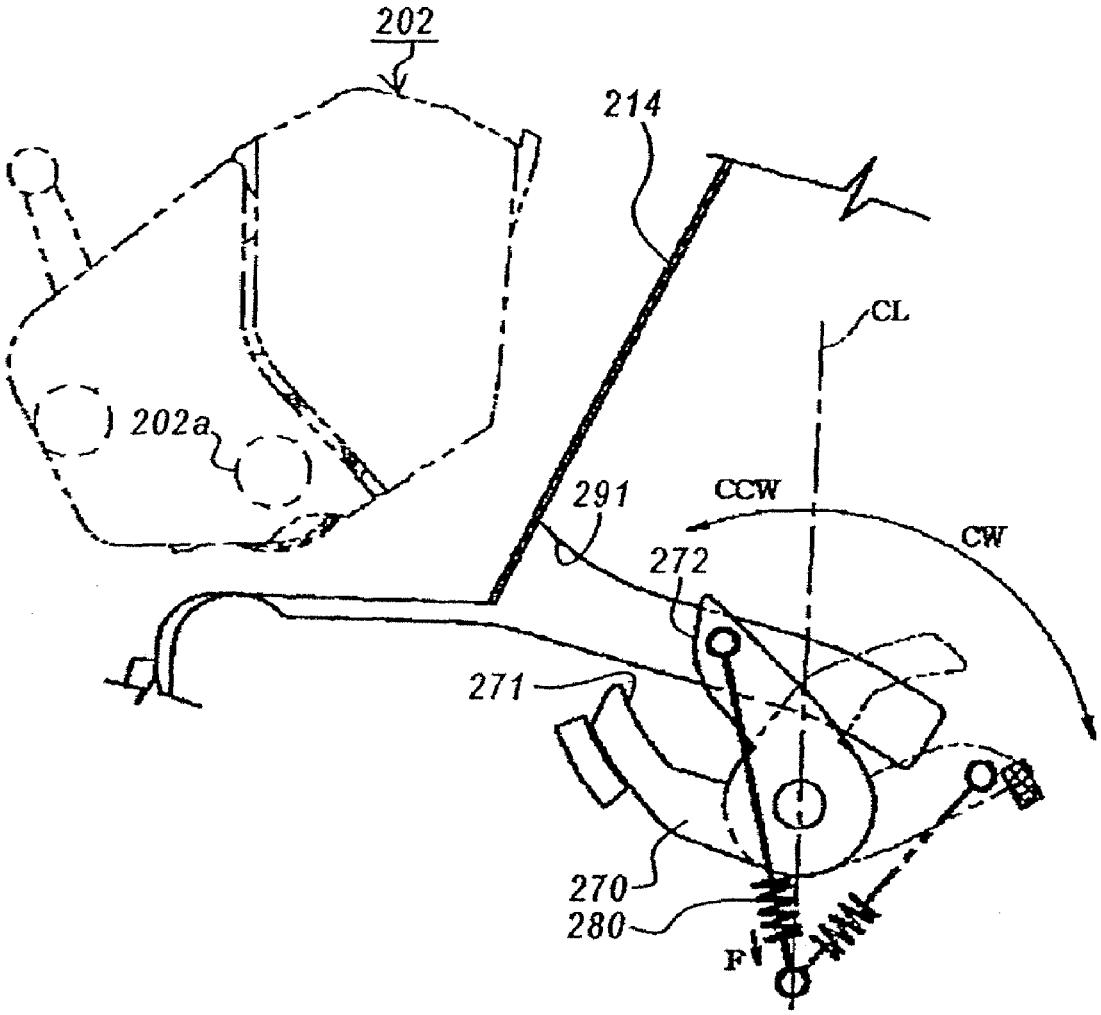
FIG.7 PRIOR ART
FIG. 7 is a diagram used for explaining a detachably attaching structure of another conventional process cartridge.

First, the operator opens the upper door unit 101 shown in FIGS. 5(*a*) and 5(*b*) upward of the apparatus body, and exposes an attaching position of the cartridge 10 comprising the pair of left and right side plates 60 to a person who attaches the cartridge (the upper door unit 101 can be held at a position where the upper door unit 101 is opened to its upper limit position above the apparatus body).

Next, the operator slips an inclined surface 10*a* provided on a bottom surface 6 of the cartridge along a guide inclined surface 61*a* formed on a guide member 61K in a first attaching position (position of the cartridge 10K in FIG. 1) with respect to a U-shaped groove 70K of the cartridge, and the operator drops the cartridge 10 into the apparatus body. With this operation, the cartridge is moved to a second attaching position (position of the cartridge 10C in FIG. 1) with respect to the U-shaped groove 70K.

In a second attaching position, the cartridge 10 is engaged with the engaging portion 95 of the toggle arm 90 by the projection surface 51. In this state, if the operator further drops the cartridge 10 into the apparatus body and applies a force exceeding the moment in the X direction acting on the toggle arm 90 by the extension spring 98, the cartridge 10 moves into the apparatus body. Next, when the operator further drops the cartridge 10 and the moment acting to the toggle arm 90 by the extension spring 98 is switched into the Y direction, the cartridge is instantaneously pulled into the apparatus body by the latch portion 91 provided on the toggle arm 90 by the moment and by the force applied by the operator to the cartridge, and the cartridge is moved to a third attaching position (position of the cartridge 10M in FIG. 1) with respect to the U-shaped groove 70.

The third attaching position is a normal position where an image can be formed when the cartridge 10 is attached, and where the circular projection 50 of the cartridge 10 butts against the bottom of the U-shaped groove 70. That is, in a state in which the projection 50 is positioned at the normal position of the side plate 60, the latch portion 91 applies a downward force to the circular projection 50 by the moment in the Y direction acting on the toggle arm 90. Therefore, the cartridge 10 is reliably positioned in the apparatus body, the toggle arm 90 instantaneously pulls the cartridge 10 and thus, the cartridge 10 does not float during the attaching operation and is not caught. When the cartridge 10 is inserted into the third attaching position (position where an image can be formed), the position of the cartridge 10 with respect to the body (housing) is varied whenever the cartridge is inserted due to tolerances (backlash) of the parts even if the same body and the same cartridge are used. On the other hand, the apparatus body has tolerance so that the apparatus body forms an image when the process cartridge is within somewhat wide range. That is, when the toggle arm 90 fixes the cartridge 10 to a position where the image can be formed, a phase when the toggle arm 90 is secured is provided with somewhat wide width.

As explained above, the toggle arm 90 includes the first inclined surface 92 and the second inclined surface 93 which also function as the guide surfaces when the cartridge is inserted. These inclined surfaces oppose to the cartridge 10 of the toggle arm 90 and assist the attaching operation of the cartridge in adjacent stations when the toggle arm 90 is in the first position (position where the cartridge is opened) and the second position (position where the cartridge is secured). Therefore, these inclined surfaces are formed such that substantially extension surfaces are formed with respect to the guide inclined surface 61*a* of the guide member 61. With the first inclined surface 92 and the second inclined surface 93, the attaching motion of the adjacent cartridges 10 to the apparatus body becomes smoother, and the float and catching during the attaching operation can further be reduced.

The third inclined surface 94 opposed to the cartridge 10 of the toggle arm 90 is arranged such that the third inclined surface 94 forms a surface which is substantially in parallel to the guide inclined surface 61*a* of the guide member 61 when the toggle arm 90 is in the first position. With this configuration, not only the adjacent cartridges, but also a cartridge which secures can function as a guide.

When the cartridge 10 is detached from the apparatus body, if a person who attaches applies a force to the cartridge to a pulling out direction from the apparatus body, the cartridge 10 can be detached by the retrograde procedure.

The above-described cartridge attaching operation is repeated by the same number as that of the stations of yellow, magenta, cyan and black and then, the operator closes the upper door unit 101 shown in FIGS. 5(*a*) and 5(*b*) downward of the apparatus body, and returns the transfer belt unit 12 to the normal position of the apparatus body.

As shown in FIGS. 4(*a*) and 4(*b*), a projection 12*a* is provided at a position corresponding to the toggle arm 90 of the transfer belt unit 12. The projection 12*a* has such a shape that it can approach closest when the toggle arm 90 is in an attitude where the cartridge 10 is properly attached, and that the projection 12*a* abuts against the toggle arm 90 and the transfer belt unit 12 can not be closed when the toggle arm 90 is in a different attitude.

Therefore, when the cartridges 10 are attached to all of the stations properly as shown in FIG. 4A, the transfer belt unit 12 can properly attached to the normal position on the apparatus body. However, when there exists a station to which no cartridge is attached as shown in FIG. 4B, the projection 12*a* provided on the transfer belt unit 12 interferes with the latch portion 91 of the toggle arm 90 and the transfer belt unit 12 is not returned to the normal position, thereby preventing the transfer belt unit 12 from closing. The same effect can be obtained when the cartridge 10 is not in a normal position, for example, when the cartridge 10 is floating.

With this structure, when the cartridge 10 is not attached, or when the cartridge 10 is not in the normal position, i.e., when the cartridge 10 is in a phase other than a securing phase of the cartridge 10, it is possible to prevent the cartridge 10 from colliding against the belt, and to prevent the transfer belt unit 12 from being attached. Therefore, due to the fact that the apparatus body does not form an image, it is possible to reliably prevent the transfer belt unit 12 from being damaged due to excessive load or erroneous attachment.

According to the structure explained in detail above, it is easy to attach the cartridge 10 to the apparatus body, appropriate operating feeling can be maintained, and it is possible to reliably position and hold the cartridge 10 when the attaching operation thereof is completed. The cartridge 10 does not damage the image forming region of the transfer belt unit 12, and the transfer belt can be protected.

Although the transfer belt unit 12 is attached to the upper door unit 101 in the above explanation of the body structure, it is not always necessary to provide the transfer belt unit. Alternatively, the transfer belt unit 12 and the upper door unit 101 may be independently opened and closed, and after the upper door unit 101 is opened, the transfer belt unit 12 may be detachably attached alone. In this case, a belt frame existing in a region other than the image forming region of the transfer belt unit 12 may be provided with a portion corresponding to the projection 12*a* which abuts against the toggle arm 90.

Although the primary transfer surfaces which are opposed surfaces of the transfer belt unit 12 and the photosensitive member drum 18 in the cartridge 10 in the drawing are inclined through a certain angle in the embodiment, the invention is not limited to this angle, and optimal inclination angle may be selected in accordance with requirement depending upon the height of the fixing apparatus, the size of the light-exposure apparatus 11 and the like, or the inclination angle can be eliminated and the primary transfer surfaces may be disposed horizontally.

The opening and closing motion of the upper door unit 101 is a turning motion in FIG. 5B in the embodiment, but this opening and closing motion may be moving motion including sliding.

The present invention can be utilized for an image forming apparatus to which a cartridge can detachably attached.

CROSS REFERENCE TO RELATED APPLICATION

This application claims the benefit of priority from the prior Japanese Patent Application No. 2004-281645 filed on Sep. 28, 2004 the entire contents of which are incorporated by reference herein.

What is claimed is:

1. An image forming apparatus comprising:

an image forming unit capable of being detachably attached to a housing body of said image forming apparatus;

a guiding portion configured and positioned to guide said image forming unit to the housing body of said image forming apparatus;

an opening and closing member configured and positioned to open said guiding portion;

a securing member which can rotate from a releasing position where said image forming unit is detached from the housing body to a securing position where said image forming unit is secured to the housing body of said image forming apparatus, according to an operation for attaching said image forming unit with said guiding portion; and a preventing portion arranged on said opening and closing member and which enables said opening and closing member to be closed when said securing member is in the securing position and prevents said opening and closing member from being closed when said securing member is in the releasing position.

2. The image forming apparatus according to claim 1, wherein said preventing portion is a projection which projects toward said securing member when said opening and closing member is closed.

3. The image forming apparatus according to claim 1, wherein said opening and closing member holds an intermediate transfer body and said preventing portion is formed outside of the area where the intermediate transfer body operate.

4. The image forming apparatus according to claim 3, wherein the intermediate transfer body and said opening and closing member are closed as in one body.

5. The image forming apparatus according to claim 1, wherein said securing member is configured and positioned to guide one image forming unit to an adjacent securing portion next to a securing portion in which said securing member secures another image forming unit when said securing member is in the releasing position.

6. An image forming apparatus according to claim 5, wherein a part of said securing member forms an extension surface extending from a guide inclined surface of said guiding portion.

7. An image forming apparatus according to claim 1, wherein said securing member is disposed beside an entrance of a securing portion of said image forming unit.

8. An image forming apparatus according to claim 1, wherein said image forming unit has a image bearing member and said securing member can secure a shaft of said image bearing member.

9. An image forming apparatus according to claim 1, wherein said image forming apparatus has a bumping portion which said image forming unit bumps when said image forming unit is secured in the housing body of said image forming unit and said securing member can push said image forming unit toward the bumping portion.

* * * * *

UNITED STATES PATENT AND TRADEMARK OFFICE

CERTIFICATE OF CORRECTION

PATENT NO. : 7,187,886 B2
APPLICATION NO. : 11/220648
DATED : March 6, 2007
INVENTOR(S) : Ryoichi Kawasumi It is certified that error appears in the above-identified patent and that said Letters Patent is hereby corrected as shown below:

COLUMN 4:
Line 56, “a image” should read --an image--.

COLUMN 5:
Line 47, “can” should read --can be--.
Line 50, “can” should read --can be--.
Line 63, “FIG. 4” should read --FIGS. 4(a) and 4(b)--.

COLUMN 8:
Line 41, “can” should read --can be--.

COLUMN 10:
Line 19, “operate” should read --operates--.
Line 37, “a image” should read --an image--.

Signed and Sealed this

Twenty-ninth Day of July, 2008

JON W. DUDAS
*Director of the United States Patent and Trademark Office*